United States Patent [19]

Rushton

[11] 3,942,283

[45] Mar. 9, 1976

[54] HAND PUPPET

[76] Inventor: Mary P. Rushton, 320 W. Paces Ferry Road, NW., Atlanta, Ga. 30305

[22] Filed: Mar. 27, 1975

[21] Appl. No.: 562,845

[52] U.S. Cl. ..... 46/154; 46/158
[51] Int. Cl.[2] ..... A63H 3/14
[58] Field of Search ..... 46/154, 158

[56] References Cited

UNITED STATES PATENTS

| | | | |
|---|---|---|---|
| 2,655,762 | 10/1953 | Burke | 46/154 X |
| 2,729,024 | 1/1956 | Guttmann | 46/154 |
| 2,756,448 | 7/1956 | Werbe | 46/154 X |
| 2,795,896 | 6/1957 | Snyder | 46/154 |
| 3,820,276 | 6/1974 | Goldfarb et al. | 46/154 |

*Primary Examiner*—Louis G. Mancene
*Assistant Examiner*—Jack Q. Lever
*Attorney, Agent, or Firm*—Sherman & Shalloway

[57] ABSTRACT

A hand puppet resembling a stuffed animal has a pocket extending therein into which the hand of a manipulator is inserted. The pocket is configured to extend into the legs and head of the animal so that the legs and head may be moved by the fingers of the manipulator. Behind the pocket, there is a cavity which is filled with polyurethane foam or the like so that the back portion of the animal retains its shape as the animal is manipulated.

11 Claims, 4 Drawing Figures

FIG. 1
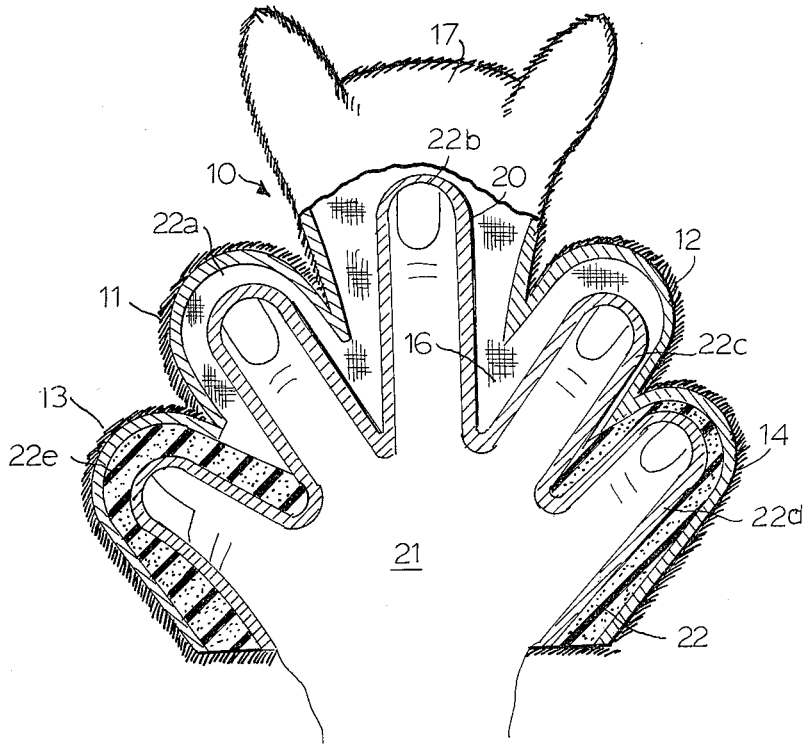
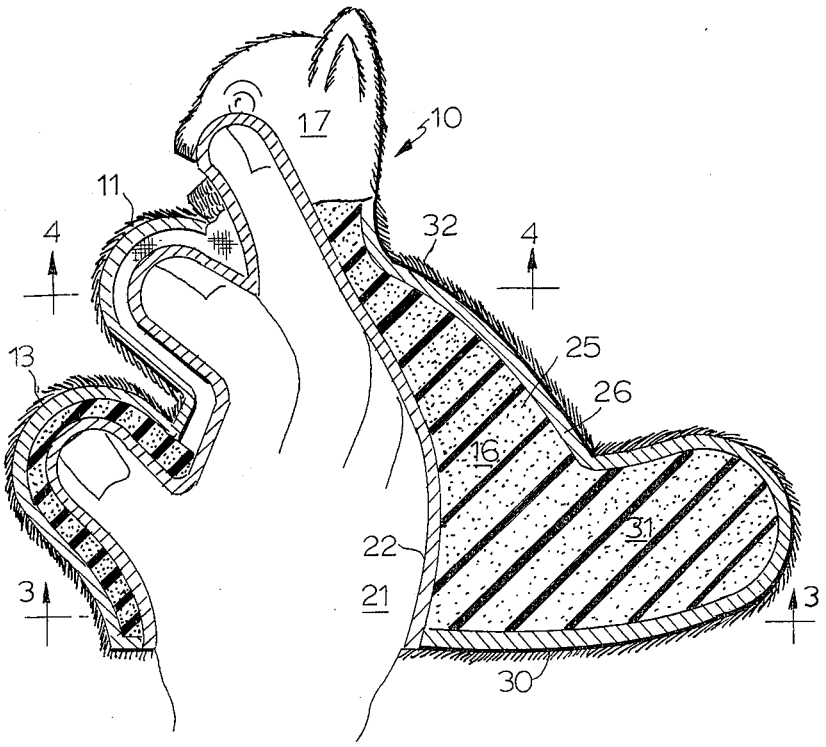
FIG. 2

HAND PUPPET

BACKGROUND OF THE INVENTION

1. Field of the Invention

This invention relates to hand puppets and, more particularly, this invention relates to hand puppets preferably configured to resemble stuffed animals.

2. Technical Considerations and Prior Art

Stuffed animals have long been a source of great pleasure and amusement to children, as well as adults. However, most stuffed animals are constructed so that their heads and appendages cannot be manipulated in a convenient manner so as to mimic a living animal.

Hand puppets have also long been a source of great amusement to children and adults; however, hand puppets of the prior art are not configured so as to retain the cuddly attractiveness of stuffed animals.

Exemplary of the type of stuffed animal whose appeal would be greatly enhanced if it could be manipulated is the "teddy bear." Other stuffed animals resembling a teddy bear in general configuration also would benefit from the ability to be rationally manipulated. In constructing such stuffed animals, it is desirable that the head and appendages of the animal be readily pivoted so that they fold inwardly toward the animal's stomach, chest or front, while the back of the animal retains its form. It is also desirable that the animal retain its shape when not being manipulated as a hand puppet so that it is attractive when sitting on a shelf in a store or when, for example, sitting on a child's bed.

The prior art hand puppets and stuffed animals do not fulfill these conditions because, generally, they have not been constructed with the concept in mind of combining, in one configuration, the attributes of both a stuffed animal and a hand puppet.

Exemplary of the prior art are the following U.S. utility Pat. Nos.: 1,417,860; 1,683,110; 2,619,771; 2,729,024; 2,756,448; 2,795,896; 3,032,922; and 3,820,276. The following are exemplary of the prior art U.S. design Pat. Nos.:59,182; 66,876; 132,473; 149,595; 163,733; 163,734; 164,973; 166,051; 224,325; and 231,841.

OBJECTS OF THE INVENTION

In view of the deficiencies of the prior art, it is an object of the instant invention to provide a new and improved hand puppet.

It is another object of the instant invention to provide a new and improved stuffed toy.

It is an additional object of the instant invention to provide a new and improved stuffed toy which resembles an animal.

It is a further object of the instant invention to provide a new and improved toy which combines the attributes of a hand puppet and a stuffed animal.

It is yet another object of the instant invention to provide a new and improved combination of a stuffed animal and hand puppet which is quite pleasing in appearance.

It is still a further object of the instant invention to provide a new and improved stuffed animal which may be manipulated in such a way so as to mimic a live animal.

It is an additional object of the instant invention to provide a hand puppet which has a pleasing and decorative appearance, even when not being manipulated.

SUMMARY OF THE INVENTION

In view of these and other objects, the instant invention contemplates a hand puppet which resembles a stuffed toy having a body portion which is defined by front, back and bottom surfaces. A head and first and second pairs of appendages project from the body portion, and are interconnected by a pocket which extends through the bottom of the body portion and registers with the head and appendages. The pocket is configured so that a human hand may readily be received therein to manipulate the toy. Stuffing is inserted in a cavity within the toy in order to keep the back of the toy erect while allowing the toy to retain its softness. There is no stuffing adjacent the front surface of the toy.

BRIEF DESCRIPTION OF THE DRAWINGS

FIG. 1 is a back view of a stuffed hand puppet in accordance with the instant invention, partially cut away to show a hand engaging the head and appendages of the puppet.

FIG. 2 is a side view of the hand puppet of FIG. 1, partially cut away to show the interior structure of the hand puppet and how the hand fits therein.

DETAILED DESCRIPTION OF THE PREFERRED EMBODIMENT

Figure 3:
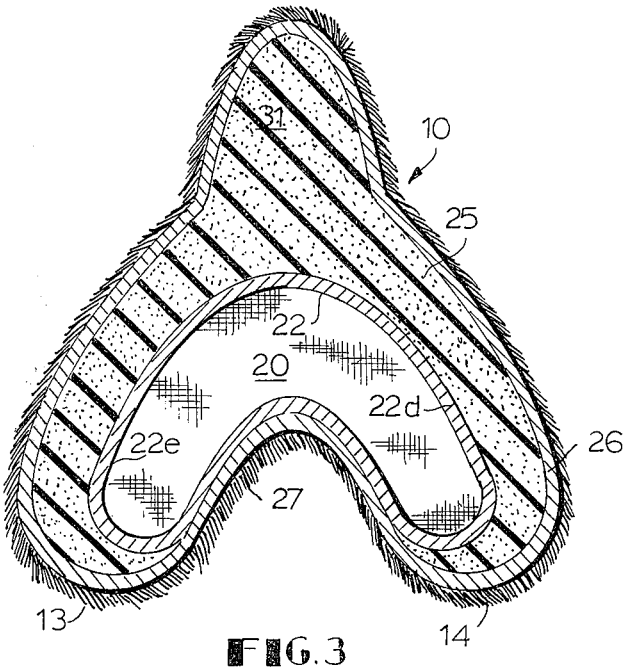
FIG. 3 is a bottom section of the hand puppet taken along lines 3—3 of FIG. 2.

Referring now to FIG. 1, there is shown a hand puppet, designated generally by the numeral 10, which is in the form of a stuffed animal. The hand puppet has four appendages 11, 12, 13 and 14 which extend from a body portion, generally designated by the numeral 16. The appendages 11 and 12 form the front legs of the animal, while the appendages 13 and 14 form the rear legs. If it is desired, each appendage may have paws or claws (not shown) attached thereto. A head 17 projects upwardly from the body portion.

In order to manipulate the stuffed hand puppet 10, a pocket 20 is provided which extends up into the body portion and into which a person's hand 21 may be inserted. The pocket 20 is defined by a liner 22 which terminates in a series of depending recesses **22*a*, 22*b*, 22*c*, 22*d* and 22*e* formed in the appendages and head of the stuffed puppet. The recesses 22*a* through 22*e* receive the fingers of the hand 21 and allow the appendages 11 through 14 and head 17** to be manipulated with the fingers.

Figure 4:
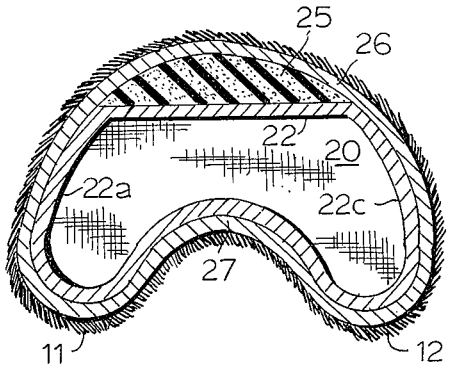
FIG. 4 is a section of the puppet taken along lines 4—4 of FIG. 2.

Referring now specifically to FIGS. 2 through 4, it is seen that stuffing 25 is positioned behind the back of the liner 22 forming the pocket 20 between the back of the liner and the back 26 of the puppet. As best seen in FIGS. 3 and 4, there is no stuffing 25 in the front 27 of the body portion 16. The stuffing 25, however, does extend around the back of liner portion **22*d* and 22*e* which define the pocket recesses extending into the appendages or rear legs 13 and 14 of the puppet. As seen in FIG. 4, there is no stuffing 25 extending around the liner portions 22*a* and 22*b* defining the pocket recesses extending into the appendages or front legs 11 and 12. By having such an arrangement, the stuffed toy has a broad base 30 upon which to rest so that when the toy is not being manipulated by one's hand, it retains it stuffed animal characteristics. In addition, while resting on the base 30, the toy will not fall over. The stuffing 25** may be of any convenient material; however, a material such as polyurethane foam is preferred, since it is soft, resilient and washable.

It should be kept in mind that the stuffed hand puppet 10 may assume any convenient configuration, and may be provided with such components as a tail 31 (shown in FIGS. 2 and 3) and with fur 32. In coloring, it is preferable to make the fur along the back of the puppet and extending around the sides of the puppet dark in color, while making the fur along the base or bottom 30 and front or stomach 27 of the puppet light in color or white.

The foregoing embodiment is merely illustrative of an example of the invention, and the invention should be limited only by the following appended claims.

What is claimed:

1. A hand puppet shaped like and having the characteristics of a stuffed toy and being configured for manipulation by five fingers of a hand, comprisng:

a body portion defined by front, back and bottom surfaces;

a head projecting from said body portion at an end of said body portion opposite said bottom surface;

first and second pairs of appendages projecting from said body portion, wherein the first pair of appendages are disposed adjacent the bottom surface of the body portion and the second pair of appendages are disposed between the first pair and head;

a pocket extending in said body portion and terminating inside of said appendages and said head to form five depending recesses, each of which is adapted to receive a finger, said pocket being juxtaposed to the front of the body portion so that the palm of the hand is just behind the front surface of the body portion;

a cavity disposed between the pocket and the back of the body portion; and stuffing means contained within said cavity for substantially maintaining the shape of at least said back of the body portion as the puppet is manipulated, said stuffing means having sufficient stiffness to maintain the stuffed toy shape of the hand puppet when a hand is not in the pocket and being so located that the hand puppet will rest on the bottom surface without falling over.

2. The hand puppet of claim 1, wherein the cavity between said pocket and the back of the body extends behind the depending recesses in the first pair of appendages and wherein the stuffing also extends behind the depending recesses.

3. The hand puppet of claim 2, wherein the hand puppet is in the form of an animal.

4. The hand puppet of claim 1, wherein the hand puppet is in the form of an animal.

5. The hand puppet of claim 3, wherein a tail projects from the back of the body portion and wherein a portion of the cavity extends into the tail and the stuffing fills the portion of the cavity extending into the tail.

6. The hand puppet of claim 1, wherein the stuffing is polyurethane.

7. The hand puppet of claim 3, wherein the stuffing is polyurethane.

8. The hand puppet of claim 2, wherein the cavity of the body portion terminates so as not to extend around the second pair of appendages.

9. The hand puppet of claim 4, wherein the first pair of appendages form back legs of the animal and the second pair of appendages form front lets of the animal.

10. The hand puppet of claim 1, wherein the cavity opens through the bottom surface of the body portion.

11. The hand puppet of claim 5, wherein the cavity and stuffing extend into the head.

* * * * *